United States Patent [19]

Tereshinski

[11] Patent Number: 4,719,651

[45] Date of Patent: Jan. 19, 1988

[54] FOLDING PARTY HAT

[75] Inventor: Edward G. Tereshinski, Kalamazoo, Mich.

[73] Assignee: Kalamazoo Banner Works, Inc., Kalamazoo, Mich.

[21] Appl. No.: 912,749

[22] Filed: Sep. 26, 1986

[51] Int. Cl.[4] ..... A42B 1/22; A42B 1/20; A42B 1/24

[52] U.S. Cl. ..... 2/197; 2/199; 2/200; 2/209.1; 2/DIG. 11

[58] Field of Search ..... 2/175, 171, 195, 198, 2/199, 197, 200, 196, 209.1, DIG. 11, 185 R

[56] References Cited

U.S. PATENT DOCUMENTS

| | | | |
|---|---|---|---|
| 1,752,172 | 3/1930 | Gust | 2/171 X |
| 2,679,711 | 6/1954 | Learnard | 2/197 X |
| 2,694,812 | 11/1954 | Neuburger | 2/209.1 |
| 2,765,472 | 10/1956 | Schoenwolski | 2/200 X |
| 2,787,791 | 4/1957 | Linney et al. | 2/200 X |
| 2,828,487 | 4/1958 | McNeill et al. | 2/196 |
| 2,837,746 | 6/1958 | Gundy | 2/198 X |
| 3,358,293 | 12/1967 | Wanamaker | 2/195 |
| 3,360,801 | 1/1968 | Parrilla | 2/199 |
| 3,869,727 | 3/1975 | Hartman et al. | 2/175 |
| 4,646,367 | 3/1987 | Hassen | 2/171 X |

FOREIGN PATENT DOCUMENTS

| | | | |
|---|---|---|---|
| 0817254 | 5/1937 | France | 2/171 |

OTHER PUBLICATIONS

1986 Mini Menagerie Calendar produced by Hallmark Cards, Inc.

*Primary Examiner*—Peter Nerbun

*Attorney, Agent, or Firm*—Flynn, Thiel, Boutell & Tanis

[57] ABSTRACT

A foldable party hat having a number of flat, planar panels foldably connected to form an elongated strip. The ends of the strip are adjustably connectable with one another to form a hat band. The panels are also foldable into a compact configuration, with some of the panels folding over the others to cover the others and engage together to hold the folded band in its folded configuration. A further aspect of the invention is that the hat is adapted to hold novelties, such as balloons, on the surface thereof, to give the hat a festive appearance.

6 Claims, 4 Drawing Figures

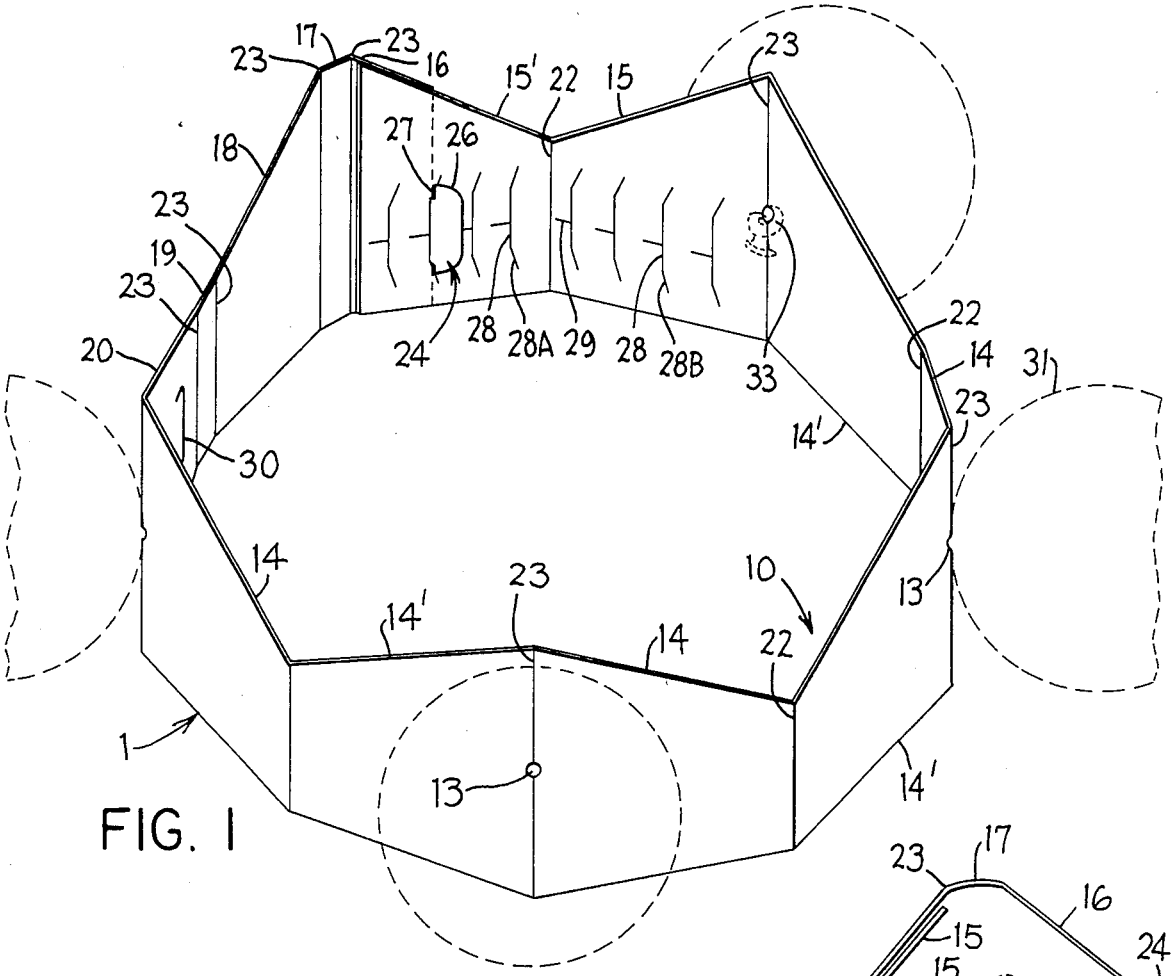
FIG. 1
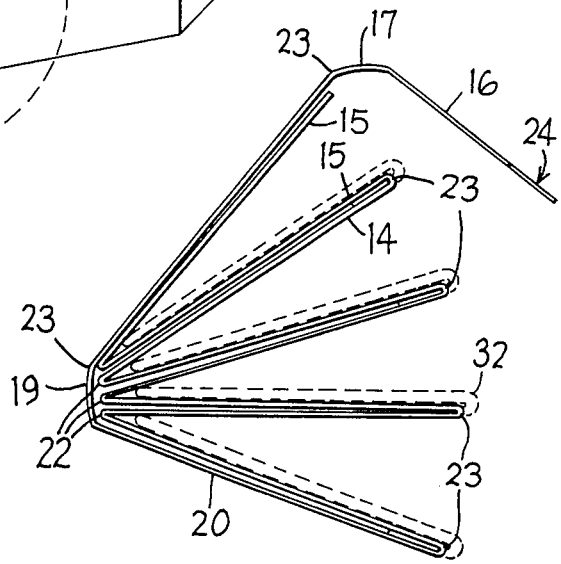
FIG. 2
FIG. 3
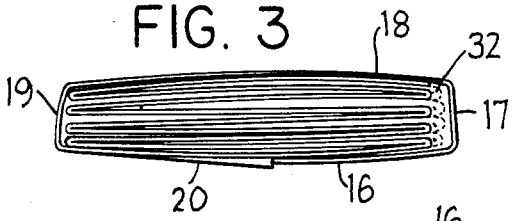
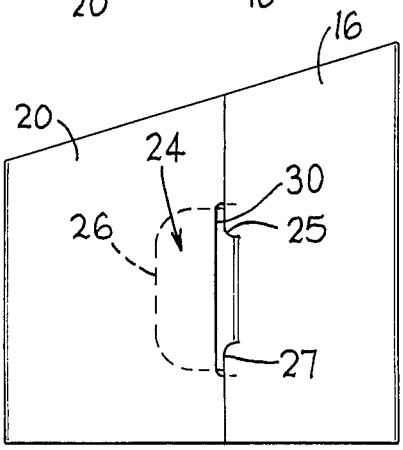
FIG. 4

FOLDING PARTY HAT

FIELD OF THE INVENTION

This invention relates to hats, particularly party hats, which are adjustable in size to fit a wide range of wearers and which includes plural panels foldable into a compact structure to be easily transported, displayed and sold in small packages. In a preferred embodiment, the hat carries balloons attached to the panels as a festive decoration.

BACKGROUND OF THE INVENTION

Party hats and other forms of novel headgear have long been known in the art and are synonymous with revelry and a fixture at many festive gatherings. Of numerous types of festive headgear two examples are particularly well known, these being the conical cap, the chapaeu cliche of childrens' birthday parties, held tightly on top of the wearer's head by a taut string or elastic band passed under the chin and the straw boater, typically seen at political conventions emblazoned with slogans and candidates names about the hat band thereof; truly a party hat. These hats, however, have some major drawbacks. Firstly, they are not adjustable to fit various head sizes. Secondly, they are not readily reduced to a compact size to facilitate easy storage, shipping and/or packaging for sale. Thirdly, the conical hat and boater are far too common place to suit the wants and needs of some particularly festive individuals.

Other inventors have addressed the issues in headgear of size adjustability, reduction to a compact size and festive appearance with various results. One development disclosed in U.S. Pat. No. 3,184,157 comprises a visor and an adjustable head band with a decorative, fanciful bird face represented on a panel attached to the visor portion. The headband of this hat comprises first and second arms extending rearwardly from the visor. The arms are adapted to be fastened together by means of a hook on the first arm passing through an eyelet at the end of the second arm with the hook at the end of the first arm being adapted to selectively engage one of a series of corresponding slits in an edge of the second arm, thereby resulting in a headband, the circumference of which is adjustable. The decorative panel is attached to the visor by means of tabs on the panel which pass through corresponding slits in the visor and projecting spurs on the panel which engage a notch on the front edge of the visor.

Another novelty head dress is disclosed in U.S. Pat. No. 2,679,711 comprising a size-adjustable headband and a crown strap on which a upwardly projecting spindle is attached. The spindle features a rotatable hub mounting a plurality of radially extending feathers. The headband is made adjustable by means of a key formed in one end of the headband strip which lockably fits into one of a series of T-shaped keyholes at the other end of the strip.

A balloon carrying hat is shown in U.S. Pat. No. 3,360,801 which comprises a stretchable hemispherical cap worn over the head having a polar opening therein through which an inflated balloon is attached.

U.S. Design Pat. No. 49,678 discloses an elongate unfolded striplike structure on which circus scenes and related representations are imprinted. The top edge thereof is cut to generally conform to the shape of the printed scenes. The longitudinal ends of the strip are joined together in an undisclosed fashion to form a decorated hat or hat band.

A broad brim foldable hat is disclosed in U.S. Pat. No. 3,869,727. The crown, crown wall, and brim sections of the hat are of rigid material and are interconnected into a hat shape and made foldable by passing yarn through perforations in the edges of the panels.

Also known in the art but unrelated to hats and apparel is a folding pocket calendar. The calendar comprises a plurality of panels on which the various months of the year are represented foldably connected together in a strip. A series of panels is specially adapted to cover the folded-up panels and hold them in their folded configuration by a tab inserted into a corresponding slot in one of the panels.

OBJECT OF THE INVENTION

It is an object of the present invention to provide a party hat which is foldable into a compact, generally matchbook-size structure. It is another object of the invention to provide a party hat, as aforesaid, which is adjustable in size to fit a variety of head sizes. Yet another object of the invention is to provide a festively decorated party hat with balloons or other objects attached to the hat.

SUMMARY OF THE INVENTION

A foldable party hat including a longitudinally extending strip of a plurality of foldedly connected panels and first connecting structure for detachably connecting end portions of the strip together in hat band-form and second connecting structure for detachably connecting one end portion of the strip to a predetermined intermediate panel for holding the strip in a folded configuration.

BRIEF DESCRIPTION OF THE DRAWINGS

FIG. 1 is a perspective view of the hat in its wearing configuration with inflated balloons shown in broken lines;

FIG. 2 is a plan view of the hat with deflated balloons shown in broken lines, the hat being in a partially folded configuration;

FIG. 3 is a plan view showing the hat, with deflated balloons shown in broken lines, in its completely folded configuration; and FIG. 4 is a side elevation of the completely folded hat as shown in FIG. 3.

DETAILED DESCRIPTION

The foldable party hat 1 of the present invention is shown in FIG. 1 in its unfolded ready-to-wear configuration. The party hat 1 generally comprises a hat band 10 to which novelty items, such as inflated balloons 31, are optionally attached at spaced locations around the hat band 10. Although balloons are exemplified, other novelties, such as propellers, pinwheels, lights, helical springs, streamers, antennae and buttons may be attached to the hat in place of, or in combination with balloons. It is not the intention of the inventor to limit the types of novelties which may be affixed to the hat band.

The hat band 10 itself is formed from a longitudinally extending strip of flat panels 14, 14', 16, 17, 18, 19, 20 foldably connected to each other end-to-end. Each of these panels will be described in more detail below. A relatively stiff material, such as card stock, is used here to form the strip of panels. Other materials, such as plastic or stiffened cloth, may alternatively be used.

The effective strip length is determined by the size of the hat wearer's head. Hereinafter, the term "length" will relate to the longitudinally determined size of the hat components relative to the longitudinal axis of the hat band strip and the term "width" will relate to the transverse axis of the hat band strip. The length of the strip must be sufficient to form a hat band having a circumference that will fit comfortably on the head of the wearer.

The strip of the present invention includes a foldable hinge structure 22, 23 between the panels, which hinge structure extends transversely across the width of the strip at predetermined intervals along the length of the strip. As the strip shown is merely die cut from a piece of card stock sheet, the hinge structure defines the length of the panels. Other means may be used as connections between the panels when the panel material is not disposed for folding, particularly when stiff plastic is used.

The plurality of flat panels 14, 14' comprise a substantial portion of the hat band. In the embodiment shown, the hinge structure 22, 23 between the panels 14, 14' are located at spaced intervals. Although the band panels 14, 14' may be made of varying non-uniform lengths, a hat having flat panels of a uniform length is set forth here for ease of description. Preferably, the flat panels 14, 14' are adapted to be folded in an accordion-like manner (as seen in FIG. 2), with a front outwardly facing side of each panel facing the front outwardly facing side of an adjacent panel and the back inwardly facing side of each panel facing the back inwardly facing side of the other adjacent panel. The direction of the folds defining the hinge structure 22, 23 are disposed in opposite directions to facilitate the accordion-like folding. Other types of folding techniques will necessitate some changes in the dimensions of panels and hinge areas to accommodate the technique. For instance, in case the panels are intended to be successively folded over one on top of the next, each successive panel area must be of increasing length to cover the underlying group of folded panels.

Panels 14, 14' shown in the drawings differ from one another only in the shape of their top edge. Each of the panels feature a sloping upper edge surface which, when the panels are next to each other, form a peak at folds 23 and a valley at folds 22. This sloping upper surface is fanciful, resulting in a hat band with a crown-like appearance. The aspect of panel shape, could be eliminated altogether, leaving panels with only a planar, rectangular shape. Alternatively, the upper edge surfaces alone, or in combination with the lower edge surfaces of the panels, can be more fancifully formed. For example, hat band edges can also be scalloped, spiked, star shaped or otherwise formed into a multitude of decorative shapes at the maker's discretion. Furthermore, all the panel surfaces can be imprinted with slogans, pictures or other representations appropriate for the function at which the hat is worn.

Size adjustment flat panels 15, 15' located at or near one end of the hat band strip generally resemble the other panels 14, 14' in shape, size and foldable connection with each other to form a strip. However, these panels are distinguished from the others in that they provide part of the means for adjusting hat band size. As shown in FIG. 1, size adjustment flat panels 15, 15' have plural longitudinally spaced-apart size adjustment slots or perforations 28 through the surface thereof for insertion and locking engagement of a locking tab 24. The locking tab 24 is a projection extending from the end of the hat band strip opposite the end which has the size adjustment panels 15, 15'. The plurality of slots 28 provide for a wide range of size adjustments of the hat band. Preferably, each adjustment slot 28 includes a central, transversely extending portion. At the ends of the transversely extending portion and contiguous therewith are angled extensions 28A of the slot angled in the direction of insertion of the tab 24, that is, the direction in which the tab travels as it enters the slot 28. The angled extensions form an engaging surface which operatively engages laterally spaced edges on the the tab 24 to prevent an involuntary withdrawal of the tab 24 from the selected slot. The resulting size-adjusting slot 28 has a wide, shallow, U-like shape which facilitates easy insertion and locking engagement of the tab.

The size adjustment slot 28 or perforation may further incorporate an expansion slot 29 or perforation, which is a short slot relative to the slot 28, extending generally perpendicularly from the middle of the central, transversely extending portion of the size adjustment slot 28 in the direction opposite the direction of insertion of tab 24 into slot 28. Expansion slot 29 facilitates a spreading apart of the panel material in the areas adjacent the slots 28, 29 for ease of insertion and removal of the tab 24.

The end of the strip opposite the size adjustment panels 15, 15' carries a number of components necessary for holding the strip in either its hat band or closed configuration. Listed in successive order from that end of the strip to the nearest hat band panel 14, 14', the components are: tab 24; partial panel 16; first end panel 17', first cover panel 18; second end panel 19; and second cover panel 20.

Tab 24 is a projection formed at or near the end of the hat band strip opposite the end of the strip which features the size adjustment panels 15, 15'. In FIG. 1 the tab 24 is shown extending through a size adjusting slot 28. In FIG. 4 the same tab 24 is shown inserted into a closure slot 30. It can therefore be seen that the tab 24 functions in holding the strip in its hat band configuration and alternatively, holding the strip in its folded configuration.

As shown in FIG. 4, the tab 24 is generally a flat, tongue-like projection extending from the terminal edge of partial panel 16. The tab features a convexly curved or rounded leading edge 26 (shown here in phantom line), shaped to facilitate easy insertion into a slot. Immediately behind the lateral sides of the leading edge the tab is, necked-down by a slit extending into each lateral side of the tab. The slits separate the tab from the closure panel 16 at these locations and provide locking surfaces 27 behind the leading edge. As shown in FIG. 1, the locking surfaces 27 engage over the panel 15' at the areas of the angled extensions 28A of the slot 28.

To impart the tab 24 with added longitudinal flexibility for ease in insertion into slots, slits are made in the closure panel extending longitudinally away from the transverse slits forming the locking surface 27 of the tab. The result is a neck 25 extending from the panel 16 to the tab 24.

The tab 24 is an extension of partial panel 16, that is, a panel having an overall length which is less than the length of flat panels 14, 14'. The partial panel 16 is approximately half the length of the panels 14, 14'. The shorter length of the partial panel 16 permits at least a partial overlap of the partial panel 16 with the selected adjustment panel 15, 15' and, when in its folded configuration, permits at least a partial overlap of the partial panel 16 with the closure panel 20.

Partial panel 16 is foldably connected to a first end cover panel 17 about the hinge structure 23. As in FIGS. 2 and 3, when the hat band is in its folded configuration the first end cover panel is of sufficient length to cover the folded ends of the panels 14, 14', 15, 15' and provide an edge surface to which the next successive panel, cover panel 18, is foldably attached. Cover panel 18 has substantially the same form as the hat band panels 14, 14', 15, 15'. However, cover panel 18 is sized to have sufficient length to extend from the first end cover panel 17 to the second end cover panel 19, thereby extending a distance greater than the length of the hat band panels which lie folded between the two end panels. Second end cover panel 19 is substantially similar to the first end cover panel 17 in configuration and function. The second end cover panel 19 is also of sufficient length to cover the ends of the folded hat band panels 14, 14', 15, 15'. It will be noted that the second end panel 19 can be shorter in width than first end panel 17 as shown in the figures. This is merely due to the height of the edge of the panels to which each end panel is foldably joined. The width of the end panels is not a critical aspect of the invention, but it is preferred that the end panels be of sufficient height to provide a secure and durable cover for the folded ends of the hat band panels 14, 14', 15, 15'.

Foldably attached to the second end panel 19 is the second cover panel 20. The second cover panel 20 is substantially similar to the first cover panel 18 and hat band panels 14, 14', 15, 15', except that the second cover panel 20 has sufficient length to extend from the fold where it is foldably attached by hinge structure 23 to the immediately adjoining hat band panel 14 and to the second end panel 19 when the band is in its folded configuration. The second cover panel 20 is also distinguished in that it features a closure slot or perforation 30 therethrough adapted for reception and engagement with the tab 24. Here it is shown that the closure slot is centrally located in the panel 20.

The closure slot 30 may take the same form as the size adjustment slots 28 or may be of a more simple form by reason of the closure slot not being required to hold the tab 24 with the same tenacity as is required of the size adjustment slots. In its folded configuration, tab 24 and closure slot 30 are not subjected to the same stresses and movements as when the hat band is being worn. In FIGS. 1 and 4, the closure slot 30 is shown to be a central linear slit extending transversely to the panel 20 and hat band strip. The end portions of the closure slot are angled away from the direction of insertion of the tab 24. In the preferred embodiment, the angled portions of the slot are perpendicular to the central transversely extending portion of the slot. Note that these extensions are angled opposite of the direction of the angled portions of the size adjustment slots 28. Because of this difference in direction of angle of the lateral ends of the slot 30, the locking or engaging surfaces 27 of the tab 24 have no surface adjacent the closure slot 30 with which to engage. This lack of an engaging surface allows for ease and simplicity of insertion and removal of the tab 24 into and from the closure slot 30.

Partial panel 16, along with panels 17, 18, 19, 20 have dual functions as members of the hat band strip. When the ends of the strip are joined to form a hat band, the above panels function as structural members of the hat band. However, when the ends of the strip are disconnected and the band size adjusting panels 15, 15' and hat band panels 14, 14' are folded in accordion-like fashion, the panels 16–20 are folded over the accordion folded panels to form a closed matchbook-like cover, as shown in FIGS. 3 and 4.

As shown in FIG. 1, the hat features a plurality of inflated balloons 31 attached to the hat band. The inflated balloons 31 are attached to the hat at predetermined locations by means of circular openings 13 through the panels or at the folds or hinge structures 23 between the panels. Here, the inflated balloons 31 are shown attached to the hat band by passing the knotted neck 33 of each balloon through an opening 13. The stopper effect of the knotted neck 33 on one side of the hat band and inflated balloon 31 on the other side prevents accidental loss of the balloon from the opening 13.

Balloons are especially favored as novelties for use with this hat as the hat may be marketed with the balloons deflated 32 with necks unknotted for easy inflation and the hat band folded, as in FIGS. 2 and 3 with deflated balloons laying between the folded panels of the hat band. However, other novelties may be used in place of, or in combination with balloons, as previously set forth.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A folding party hat, comprising:

an elongated strip of finite length having first and second longitudinal ends and first and second panels thereat, said elongated strip comprising a plurality of foldedly connected panels, series connected to each other at folds extending transversely to a longitudinal axis of said strip and to said first and second panels, said elongated strip being adapted for alternate configuration with said panels unfolded as a hat band and with said panels folded for compact storage, each panel intermediate said first and second panels having folded ends and facing sides disposed between said ends;

first and second fastening means located adjacent said first and second ends, respectively, for facilitating a detachable connecting of said first and second ends together to effect the hat band configuration and third fastening means on a preselected panel adjacent said second end for detachable engagement with said first fastening means on a preselected panel for holding said strip in a folded configuration, said second fastening means comprising a plurality of complimentary slots on at least one panel at said second end, said third fastening means comprising a slot, and said first fastening means comprising a tab on said first end for detachable engagement with at least one of said plurality of complimentary slots and said slot defining said third fastening means, said plurality of complimentary slots being spaced apart for facilitating a size adjustable engagement between said first and second ends of said strip.

2. A folding party hat as claimed in claim 1, wherein a first predetermined plurality of adjacent panels extending from said second end are selected for folding in said folded configuration and a second predetermined plurality of adjacent panels extending from said first end are adapted for folding over and covering said first plurality of panels.

3. A folding party hat as claimed in claim 2, wherein said first plurality of panels has first and second folded ends wherein said second plurality of panels comprises, beginning with a panel foldedly connected to said first plurality of panels:

a panel (A) having said third fastening means thereon for detachable engagement with said first fastening means;

a panel (B) of sufficient length for covering said first folded ends of said first plurality of panels in folded configuration;

a panel (C) of sufficient length to cover the facing sides of said first plurality of panels in folded configuration;

a panel (D) of sufficient length to cover said second folded ends of said first plurality of panels in folded configuration; and a panel (E) extending in at least overlapping relation to said panel (A) having thereon said first fastening means for detachable engagement with said third fastening means on said panel (A).

4. A folding party hat as claimed in claim 1, wherein said hat further comprises one or more inflatable balloons attached to said strip.

5. A folding party hat as claimed in claim 4, wherein plural ones of said transversely extending folds have holes therethrough adapted to receive the neck of a balloon.

6. A folding party hat, comprising:

an elongated strip of finite length having first and second longitudinal ends and first and second panels thereat, said elongated strip comprising a plurality of foldedly connected panels, series connected to each other at folds extending transversely to a longitudinal axis of said strip and to said first and second panels, said elongated strip being adapted for alternate configuration with said panels unfolded as a hat band and with said panels folded for compact storage, each panel intermediate said first and second panels having folded ends and facing sides disposed between said ends;

first and second fastening means located adjacent said first and second ends, respectively, for facilitatinga detachable connecting of said first and second ends together to effect the hat band configuration and third fastening means on a preselected panel adjacent said second end for detachable engagement with said first fastening means on a preselected panel for holding said strip in a folded configuration;

a first predetermined plurality of adjacent panels extending from said second end being selected for folding in said folded configuration and a second predetermined plurality of adjacent panels extending from said first end being adapted for folding over and covering said first plurality of panels, said first plurality of panels having first and second folded ends, said second plurality of panels comprising, beginning with a panel foldedly connected to said first plurality of panels:

a panel (A) having third fastening means thereon for detachable engagement with said first fastening means, said first fastening means being composed of a tab on said first end, said third fastening means being composed of a slot;

a panel (B) of sufficient length for covering said first folded ends of said first plurality of panels in folded configuration;

a panel (C) of sufficient length to cover the facing sides of said first plurality of panels in folded configuration;

a panel (D) of sufficient length to cover said second folded ends of said first plurality of panels in folded configuration; and a panel (E) extending in at least overlapping relation to said panel (A) having thereon said tab for detachable engagement with said slot on said panel (A);

said second fastening means being composed of a plurality of complimentary slots on at least one panel at said second end and adapted to detachably receive therein said tab on said panel (A); and plural ones of said transversely extending folds having holes therethrough adapted to receive the neck of a balloon.

* * * * *